United States Patent [19]

Kikuchi et al.

[11] Patent Number: 4,780,012

[45] Date of Patent: Oct. 25, 1988

[54] PAPER FEEDING CONTROL SYSTEM OF AUTOMATIC PAPER FEEDER

[75] Inventors: Hiroshi Kikuchi; Jiro Tanuma; Takao Uchida; Akira Nagumo; Shyoichi Watanabe; Yukio Ota; Tadao Shimizu, all of Tokyo, Japan

[73] Assignee: Oki Electric Industry Co., Ltd., Tokyo, Japan

[21] Appl. No.: 863,252

[22] Filed: May 14, 1986

[30] Foreign Application Priority Data

May 15, 1985 [JP] Japan ..... 60-101457

[51] Int. Cl.[4] ..... B41J 11/42

[52] U.S. Cl. ..... 400/582; 400/619; 400/625

[58] Field of Search ..... 400/625, 629, 582, 619

[56] References Cited

U.S. PATENT DOCUMENTS

| | | | |
|---|---|---|---|
| 4,396,307 | 8/1983 | Shah et al. | 400/625 |
| 4,407,597 | 10/1983 | Kapp | 400/625 |
| 4,497,589 | 2/1985 | Figini | 400/582 X |
| 4,533,269 | 8/1985 | Pou | 400/582 |

*Primary Examiner*—Paul T. Sewell

*Attorney, Agent, or Firm*—Wenderoth, Lind & Ponack

[57] ABSTRACT

A paper feeding control system of an automatic paper feeder has a setting device for enabling a position to head a printing medium to be reset. The setting device consists of a read/write enable nonvolatile memory for holding a reset value of the heading position of the printing medium. Upon taking in and setting the printing medium, an operating panel switch is operated to correct the heading position of the printing medium. In addition, the corrected value is again written in the memory, whereby the heading position of the printing medium can be corrected and altered.

3 Claims, 4 Drawing Sheets

START
DEPRESS TOF SET SWITCH AND FF SWITCH
DRIVE PLATEN DRIVING MOTOR BY ONE PULSE POSITIVITY
READ HEADING CORRECTING PULSE K
K = K + 1
WRITE HEADING CORRECTING PULSE K + 1
END

START
DEPRESS TOF SET SWITCH AND LF SWITCH
DRIVE PLATEN DRIVING MOTOR BY ONE PULSE OPPOSITELY
READ HEADING CORRECTING PULSE K
K = K − 1
WRITE HEADING CORRECTING PULSE K − 1
END

PAPER FEEDING CONTROL SYSTEM OF AUTOMATIC PAPER FEEDER

BACKGROUND OF THE INVENTION

1. Field of the Invention

The present invention relates to paper feeding control in optionally mounting an automatic paper feeder on a serial printer, etc.

2. Description of the Prior Art

Automatic paper feeders of this type are conventionally well known, each of which is mounted on a printer and feeds paper to a platen of the printer by making use of rotary force of the platen after separating printing media one at a time from a paper feeding mechanism.

Referring to FIG. 4, which illustrates a prior automatic paper feeder mounted on a printer, a paper guide 2 is provided for guiding a printing medium 3 along a platen 1, in close contact with which platen 1 press rollers 4*a* and 4*b* travel on the printing medium 3. Top and tail ends of the printing medium 3 are detected by a medium detector 5. A printing head 6 is provided for printing facing to the platen 1 driven by a platen driving motor 7. The automatic paper feeder 8 includes therein a paper feed roller 9 rotated by the platen driving motor 7 via an idle gear 10, a driving belt 11, and an electromagnetic clutch 22 for delivering the printing media 3 one at a time by a housing stacker 13 with the aid of a separating mechanism 14. The printing medium is fed through feed rollers 15*a* and 15*b*, discharged after printing, and housed in a discharge stacker 17 through discharge rollers 16*a* and 16*b*.

Referring to FIG. 5, which illustrates a control circuit for controlling paper feeding, a processing unit 18 (hereinafter referred to as a CPU) controls all of the control circuit. A read-only nonvolatile memory 19 (hereinafter referred to as a ROM) stores a control program. Designated at 20 is a read/write permit volatile memory (hereinafter referred to as a RAM). The CPU 18, ROM 19, and RAM 20, etc., are interconnected via an input/output bus 21. A driver 23 is provided for driving the head 6, the platen driving motor 7, a carriage driving motor 22, and the electromagnetic clutch 12. In addition, designated at 24 is an I/O port for the automatic paper feeder 8, and element 25 is a connector.

The following is a description of the operation of the automatic paper feeder described above which takes in in the printing medium 3 and finally discharge the medium 3.

With the CPU 18 being supplied with an intake signal issued from an interface circuit (I/F circuit) (not shown), the platen driving motor 7 is driven through the driver 3, while the electromagnetic clutch 12 on the side of the automatic paper feeder 8 is energized. With the electromagnetic clutch 12 so energized, the paper feed roller 9 is rotated via the idle gear 10 and the driving belt 11, whereby the printing media 3 are separated off one at a time with the aid of the separating mechanism 14 and forced to travel through the feed rollers 15*a* and 15*b*.

The medium detector 5 detects the top end 3*a* of the printing medium and informs the CPU 18 of this fact. Thereafter, with the passage of a prescribed period of time, the CPU 18 turns the electromagnetic clutch 12 off so as to stop the paper feed roller 9. The the printing medium 3 forced to travel by the feed rollers 15*a* and 15*b*, is held along the paper guide 2 between the platen 1 and the press rollers 4*a* and 4*b*. The platen driving motor 7, after the detection of the top end 3*a* of the medium 3 by the medium detector 5, is driven corresponding to a prescribed amount of heading of the printing medium 3 as stored in the control program, and is thereafter stopped by the CPU 18 to finish the heading of the printing medium 3.

The above arrangement however suffers from some drawbacks. Namely, there is a long travel distance of the printing medium from the medium detector 5 to a position where the heading of the printing medium is finished. Accordingly, if there are any frictional losses, any errors of mounting of the medium detector 5 and the like, then the heading position of the printing medium 3 is displaced even if the platen driving motor 7 is driven by a prescribed amount.

SUMMARY OF THE INVENTION

In view of the drawbacks with the prior automatic paper feeder, it is an object of the present invention to prevent the heading position of the printing medium 3 described above being displaced.

To achieve the above object, an automatic paper feeder mounted on a printer according to the present invention includes a read/write permit nonvolatile memory which stores a program for driving the platen driving motor 7 by a prescribed distance to reset the heading position of the printing medium as well as a combined set of switches operatable by an operator for correcting the heading position of the printing medium at will.

According to the present invention, the amount of correcting of the heading of the printing medium is stored in a read/write permit memory, whereby upon taking in and setting the printing medium, a heading position of the printing medium is made correctable by the operation of an operating panel switch, while with this corrected value of the heading position being rewritten in the memory, the heading position of the printing medium is made correctable and changeable. It is accordingly made possible to alter the heading of the printing medium at the same position as a reset position thereof in the successive operation of taking in and heading the printing medium even if the power source thereof is shut down.

The above and other objects, features and advantages of the present invention will become more apparent from the following description when taken in conjunction with the accompanying drawings in which preferred embodiment of the present invention is shown by way of illustrative example.

DESCRIPTION OF THE PREFERRED EMBODIMENT

Figure 1:
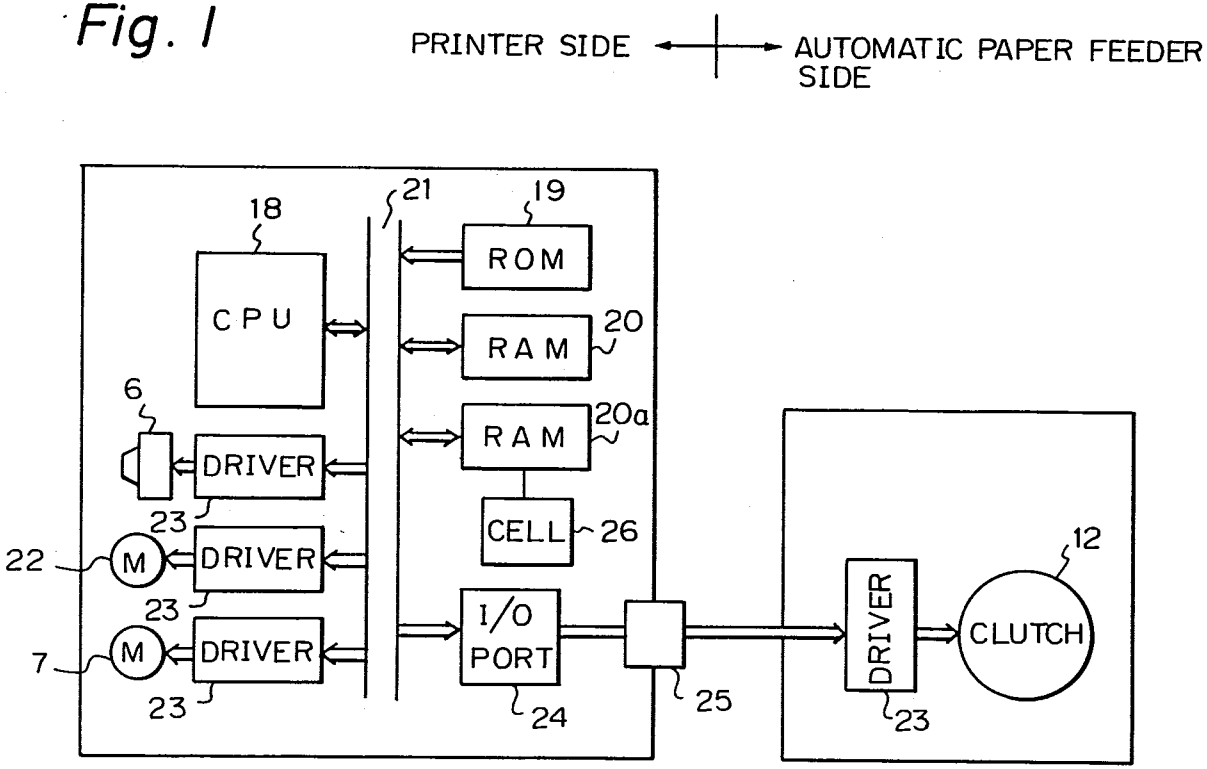
FIG. 1 is a block diagram of a control circuit illustrating a first embodiment of a paper feeding control system of an automatic paper feeder according to the present invention.

Referring here to FIG. 1 illustrating the first embodiment of the present invention, wherein the same constituent elements of the prior are described before with reference to FIGS. 3 and 4 are shown with the same reference numbers, a RAM 20*a* is operated as a read rewrite enable nonvolatile memory by backing it up with a cell 26. Here, it should be noted that pulse motors are employed as motors 7 and 22 and the amount of the heading is provided by counting the number of pulses transmitted to the pulse motor.

Figure 2:
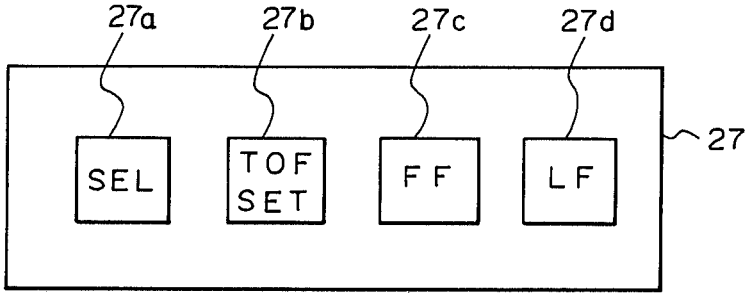
FIG. 2 shows an operating panel switch.

An operating panel switch 27, shown in FIG. 2, on a control panel (not shown) is provided on the front surface of a printer and commonly functions as follows. A SEL switch 27*a* is a selection switch for selecting operation of the printer as being in the on-line mode or the off-line mode, which is controlled to be switched whenever it is depressed. For setting printing paper and replacing an inked ribbon as well as for a function of the switch described later, the printer is placed in the off-line mode. Operating TOF SET switch 27*b* causes the position of the printing paper to be stored in a memory as a head line therein, which is employed to control one page of the printing paper.

Operating a FF switch 27*c* causes the printing paper to be fed to a head position of the next paper and operating an LF switch 27*d* causes a new line of the printing paper to be started.

Figures 3A, 3B:
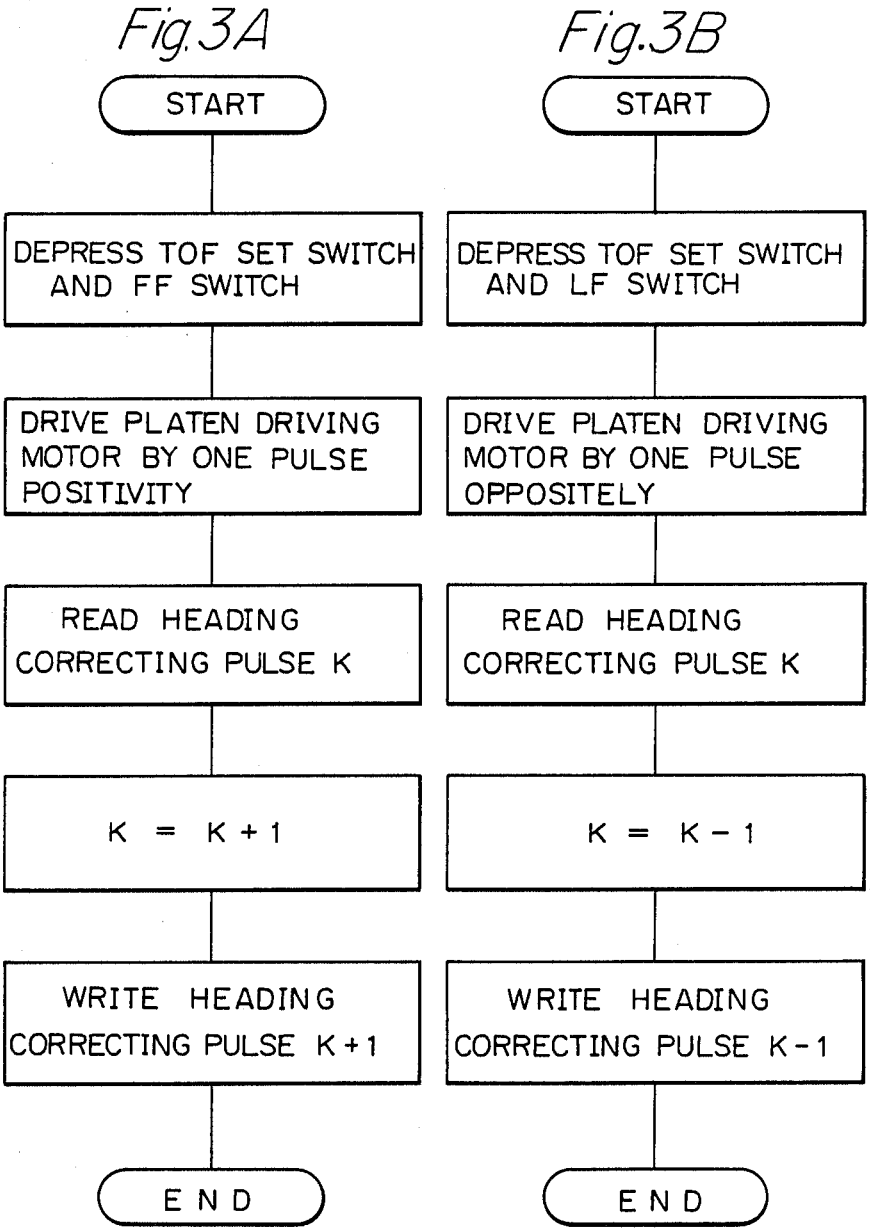
FIGS. 3(A)–3(B) are flowcharts illustrating the controlling of the automatic paper feeder.
Figure 5:
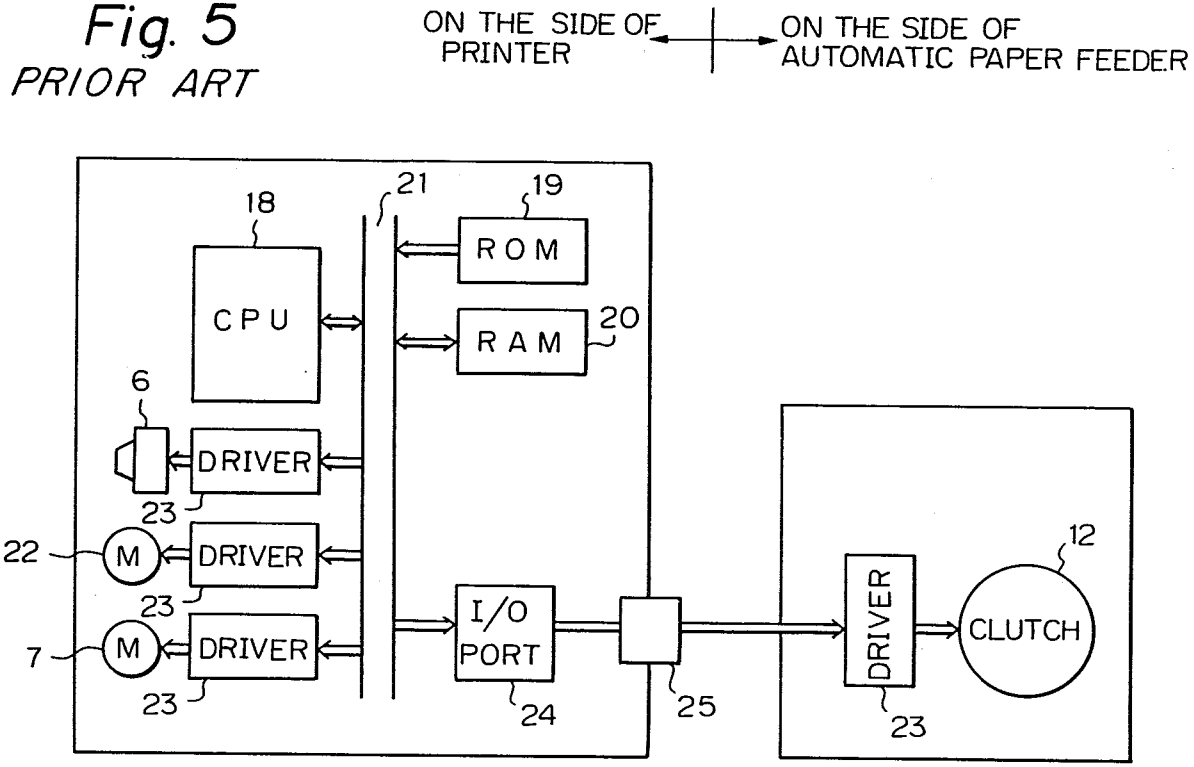
Fig. 5 PRIOR ART
FIG. 5 is a block diagram of a prior art control circuit.

In the present embodiment, each switch of the switch 27 additionally has the following programmed functions besides those described before. Namely, the automatic paper feeder 8 is mounted, the printing medium 3 is taken in as usual, the motor 7 is driven by N pulses to head the printing medium 3, and thereafter the operating mode is changed to off-line by depressing the SEL switch. Thereupon, to correct or alter the heading position of the printing medium, the FF switch 27*c* is depressed once while keeping the TOF SET switch 27*b* in its depressed state. The CPU 18 then positively drives the platen driving motor 7 by one pluse, while it reads out the number K (initial value=0) of pulses to correct in the RAM 20*a*, increments the number K to K+1, and again writes K=K+1 in the RAM 20*a*. Thus, the head position is fed forward by one pulse. In addition, with the LF switch 27*d* being depressed while keeping the TOF SET switch 27*b* in its depressed state, the CPU 18 oppositely drives the platen driving motor 7 by one pulse in the opposite direction, while it reads out the number K of pulses needed to correct the heading of the printing medium from the RAM 20*a*, decrements K to K−1, and again writes it in the RAM 20*a*. Thus, the heading position is returned backward by one pulse. Furthermore, this control procedure is shown in FIGS. 3(A)-3(B).

With the heading position being completed in its correction and alternation as described above, the TOF SET switch 27*b* is depressed as usual to reset the heading position of the printing medium 3, and thereafter the SEL switch 27*a* is depressed to return the control to the on-line mode. Accordingly, upon the succeeding operation to take in and head the printing medium 3, the CPU 18 drives the platen driving motor 7 while incrementing or decrementing the number of driving pulses to N+(K+1) or N+(K−1) after allowing the medium detector 5 to detect the top end 3*a* of the printing medium 3 and thereby enables the heading position to the altered to the same position as the reset position described above.

With the arrangement described above, the heading position can be altered with base together with the correction of any error produced owing to scattering as well as frictional load produced in heading the printing medium only with the prescribed number N of pulses for heading in the control program stored in the ROM 19. Moreover, with the same automatic paper feeder having been once mounted, the number K of the pulses to correct the RAM 20*a* with use of the cell 26 even if the power source for the printer is shut down. Accordingly, it is unnecessary to reset the automatic paper feeder even when the power source of the printer is again powered.

Figure 4:
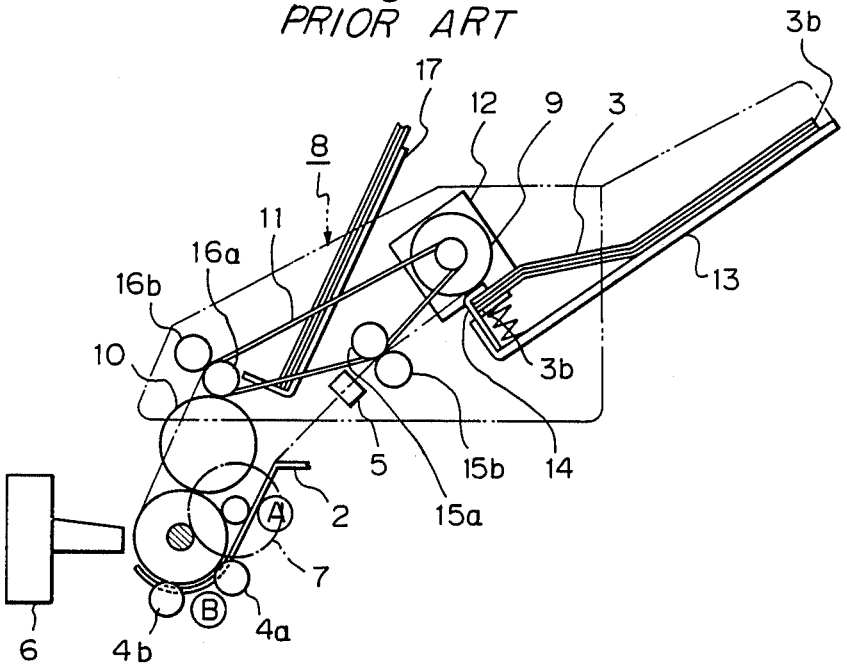
Fig. 4 PRIOR ART
FIG. 4 is a schematical side view illustrating a prior art printer.

In a second embodiment of the present invention, wherein the arrangement of the control circuit is the same as the that in the first embodiment, and the medium detector 5 is structually positioned on the side of the printer as shown by A and B in FIG. 4. Also in this case, correction and alternation of the heading postion of the printing medium are needed and made possible in the same manner as the first embodiment. However, a distance between the medium detector 5 and the heading position is less than that in the first embodiment. In addition, all possible error factors likely to be produced after the medium detector 5 detects the top end 3*a* of the printing medium are cancelled out on the side of the printer. Consequently, after once correcting and alerting the heading position, it is unnecessary to reset the automatic paper feeder 8 even if the power source of the printer is shut down as well as when the automatic paper feeder 8 is replaced.

Furthermore, for the rewrite enable nonvolatile memory, an electrically rewritable ROM (EEPROM) may be likewise employed.

With the present invention, as described above in detail, the resetting of heading position of the printing medium in a printer having an automatic paper feeder mounted thereon is made possible and held in a nonvolatile memory. Accordingly, manual operation of the automatic paper feeder by an operator at each time of the operation thereof may be eliminated. In addition, also in manufacturing the present feeder, operation to mount and adjust the medium detector may be eliminated. Thus, the present invention can provide an inexpensive and extendable printer.

What is claimed is:

1. An automatic paper feeder system of a printer for positioning the head of a printing paper by permitting the printing paper fed from an automatic paper feeder to reach a reference position and thereafter feeding it a predetermined distance comprising:

(a) a platen for feeding the printing paper;

(b) a readable/writable nonvolatile memory means for storing the amount of rotation of said platen after the printing paper has reached a reference position;

(c) a forward rotation command means for commanding a line forward rotation of said platen;

(d) a backward rotation command means for commanding a backward rotation of said platen;

(e) an arithmetic means for computing a new amount of rotation of said platen to be stored in said memory means on the basis of the amounts of rotation of the platen commanded by said forward and backward rotation command means; and (f) a means for storing a result of the computation by said arithmetic means in said memory means;

wherein said line rotation of the platen is commanded by simultaneously depressing two switches provided on an operating panel of the printer.

2. An automatic paper feeder system according to claim 1, wherein said platen is rotated by a pulse motor.

3. An automatic paper feeder system according to claim 2, wherein said pulse motor is rotated by one pulse in response to an instruction from one of said command means.

* * * * *